US008034123B2

(12) United States Patent
Penninger

(10) Patent No.: US 8,034,123 B2
(45) Date of Patent: Oct. 11, 2011

(54) BOOSTING CLEANING POWER OF DETERGENTS BY MEANS OF A POLYMER

(75) Inventor: Josef Penninger, Hilden (DE)

(73) Assignee: Henkel AG & Co., KGaA, Duesseldorf (DE)

( * ) Notice: Subject to any disclaimer, the term of this patent is extended or adjusted under 35 U.S.C. 154(b) by 273 days.

(21) Appl. No.: 11/950,146

(22) Filed: Dec. 4, 2007

(65) Prior Publication Data

US 2008/0301883 A1 Dec. 11, 2008

Related U.S. Application Data

(63) Continuation of application No. PCT/EP2006/004750, filed on May 19, 2006.

(30) Foreign Application Priority Data

Jun. 8, 2005 (DE) ..... 10 2005 026 544

(51) Int. Cl.
*C11D 3/18* (2006.01)
*C11D 3/00* (2006.01)

(52) U.S. Cl. ..... 8/137; 526/319; 510/299

(58) Field of Classification Search ..... 8/137; 510/299; 526/319
See application file for complete search history.

(56) References Cited

U.S. PATENT DOCUMENTS

| | | | |
|---|---|---|---|
| 1,985,424 | A | 12/1934 | Piggott |
| 2,016,962 | A | 10/1935 | Flint et al. |
| 2,703,798 | A | 3/1955 | Schwartz |
| 3,547,828 | A | 12/1970 | Mansfield et al. |
| 3,623,956 | A | 11/1971 | Kalabokias |
| 3,623,957 | A | 11/1971 | Feldman |
| 3,723,358 | A | 3/1973 | Morgan |
| 3,748,233 | A | 7/1973 | Viccaro |
| 3,893,929 | A | 7/1975 | Basadur |
| 4,000,093 | A | 12/1976 | Nicol et al. |
| 4,081,383 | A | 3/1978 | Warburton et al. |
| 4,116,885 | A | 9/1978 | Derstadt et al. |
| 4,136,038 | A | 1/1979 | Pracht et al. |
| 4,174,305 | A | 11/1979 | Burns et al. |
| 4,203,859 | A | 5/1980 | Gehman |
| 4,240,918 | A | 12/1980 | Lagasse et al. |
| 4,264,738 | A | 4/1981 | Stepanov |
| 4,372,868 | A | 2/1983 | Saran et al. |
| 4,435,307 | A | 3/1984 | Barbesgaard et al. |
| 4,443,355 | A | 4/1984 | Murata et al. |
| 4,585,642 | A | 4/1986 | Rieck et al. |
| 4,590,237 | A | 5/1986 | Wuhrmann et al. |
| 4,755,319 | A | 7/1988 | Smolka et al. |
| 4,820,439 | A | 4/1989 | Rieck |
| 4,832,866 | A | 5/1989 | Schulz et al. |
| 4,865,774 | A | 9/1989 | Fabry et al. |
| 5,002,695 | A | 3/1991 | Schultz |
| 5,100,796 | A | 3/1992 | Pardians et al. |
| 5,138,046 | A | 8/1992 | Wuest |
| 5,183,651 | A | 2/1993 | Schimmel et al. |
| 5,216,064 | A | 6/1993 | Rivera et al. |
| 5,236,682 | A | 8/1993 | Schimmel et al. |
| 5,268,156 | A | 12/1993 | Schimmel et al. |
| 5,308,596 | A | 5/1994 | Kotzian et al. |
| 5,356,607 | A | 10/1994 | Just |
| 5,374,716 | A | 12/1994 | Biermann et al. |
| 5,427,936 | A | 6/1995 | Moeller et al. |
| 5,534,167 | A | 7/1996 | Billman |
| 5,541,316 | A | 7/1996 | Engelskirchen |
| 5,576,425 | A | 11/1996 | Hill et al. |
| 5,718,891 | A | 2/1998 | Prat et al. |
| 5,830,956 | A | 11/1998 | Stockhausen et al. |
| 5,854,321 | A | 12/1998 | Krause et al. |
| 6,043,209 | A | 3/2000 | Micciche et al. |
| 6,187,738 | B1 | 2/2001 | Micciche et al. |
| 6,200,351 | B1 * | 3/2001 | Schleinig et al. ..... 8/115.6 |
| 6,221,824 | B1 | 4/2001 | Lietzmann et al. |
| 6,451,756 | B2 * | 9/2002 | Shulman et al. ..... 510/475 |
| 2002/0022585 | A1 * | 2/2002 | Morelli et al. ..... 510/475 |
| 2003/0158078 | A1 | 8/2003 | Chang |
| 2003/0166484 | A1 | 9/2003 | Kingma |
| 2004/0067862 | A1 | 4/2004 | Speckmann et al. |
| 2004/0110648 | A1 | 6/2004 | Jordan et al. |
| 2005/0148484 | A9 | 7/2005 | Speckmann et al. |
| 2005/0233147 | A1 | 10/2005 | Niemeier et al. |

FOREIGN PATENT DOCUMENTS

| | | |
|---|---|---|
| CA | 2299437 | 8/2000 |
| DE | 1940488 | 2/1971 |
| DE | 2044161 | 4/1971 |
| DE | 2101803 | 7/1971 |
| DE | 1617141 | 4/1972 |
| DE | 2209296 | 8/1972 |
| DE | 2253063 | 5/1973 |
| DE | 2200911 | 10/1973 |
| DE | 2412837 | 10/1974 |
| DE | 2121397 | 11/1976 |
| DE | 2655551 | 6/1977 |
| DE | 2827956 | 1/1979 |
| DE | 2846984 | 5/1979 |
| DE | 2857292 | 2/1980 |
| DE | 3117250 | 4/1982 |
| DE | 3207825 | 9/1982 |
| DE | 3207847 | 9/1982 |
| DE | 3322950 | 1/1984 |
| DE | 3324258 | 1/1984 |
| DE | 3436194 | 4/1986 |
| DE | 255884 | 4/1988 |
| DE | 4221381 | 2/1994 |
| DE | 4308794 | 4/1994 |
| DE | 4300772 | 7/1994 |
| DE | 69530692 | 3/2004 |

(Continued)

OTHER PUBLICATIONS

R. Puchta et al. A New Generation of Softeners Tens. Surf. Det. 30, (1993) p. 186.

(Continued)

*Primary Examiner* — Harold Pyon
*Assistant Examiner* — Katie L Hammer
(74) *Attorney, Agent, or Firm* — David P. LeCroy

(57) ABSTRACT

Textiles are washed by a method comprising contacting the textile with a cleaning composition comprising a copolymer comprising styrene, methacrylic acid, hydroxyethyl methacrylate, and methyl acrylate.

11 Claims, No Drawings

FOREIGN PATENT DOCUMENTS

| | | | |
|---|---|---|---|
| DE | 10221009 | | 10/2005 |
| EP | 0006638 | | 1/1980 |
| EP | 28865 | | 5/1981 |
| EP | 037026 | | 10/1981 |
| EP | 066944 | | 12/1982 |
| EP | 080223 | | 6/1983 |
| EP | 0080748 | | 6/1983 |
| EP | 92355 | | 10/1983 |
| EP | 117553 | | 9/1984 |
| EP | 130064 | | 1/1985 |
| EP | 0164514 | | 12/1985 |
| EP | 0164552 | | 12/1985 |
| EP | 167309 | | 1/1986 |
| EP | 185427 | | 6/1986 |
| EP | 204284 | | 12/1986 |
| EP | 0213500 | A | 3/1987 |
| EP | 0213729 | | 3/1987 |
| EP | 0213730 | | 3/1987 |
| EP | 0214761 | | 4/1987 |
| EP | 218272 | | 4/1987 |
| EP | 241984 | | 10/1987 |
| EP | 241985 | | 10/1987 |
| EP | 253567 | | 1/1988 |
| EP | 258068 | | 3/1988 |
| EP | 262588 | | 4/1988 |
| EP | 265832 | | 5/1988 |
| EP | 269977 | | 6/1988 |
| EP | 270974 | | 6/1988 |
| EP | 0271312 | | 6/1988 |
| EP | 272033 | | 6/1988 |
| EP | 273125 | | 7/1988 |
| EP | 274907 | | 7/1988 |
| EP | 0294753 | | 12/1988 |
| EP | 301298 | | 2/1989 |
| EP | 301414 | | 2/1989 |
| EP | 305216 | | 3/1989 |
| EP | 150386 | | 4/1989 |
| EP | 309931 | | 4/1989 |
| EP | 330641 | | 8/1989 |
| EP | 331376 | | 9/1989 |
| EP | 334462 | | 9/1989 |
| EP | 339550 | | 11/1989 |
| EP | 341947 | | 11/1989 |
| EP | 357280 | | 3/1990 |
| EP | 357969 | | 3/1990 |
| EP | 362671 | | 4/1990 |
| EP | 375102 | | 6/1990 |
| EP | 376705 | | 7/1990 |
| EP | 378261 | | 7/1990 |
| EP | 378262 | | 7/1990 |
| EP | 384717 | | 8/1990 |
| EP | 385401 | | 9/1990 |
| EP | 0425427 | | 5/1991 |
| EP | 0425428 | | 5/1991 |
| EP | 0436835 | | 7/1991 |
| EP | 451921 | | 10/1991 |
| EP | 468102 | | 1/1992 |
| EP | 0502325 | | 9/1992 |
| EP | 511456 | | 11/1992 |
| EP | 0548599 | | 6/1993 |
| EP | 0566439 | | 10/1993 |
| EP | 583536 | | 2/1994 |
| EP | 0634481 | | 1/1995 |
| EP | 0948591 | | 10/1999 |
| GB | 1154730 | | 6/1969 |
| GB | 1277801 | A | 6/1974 |
| GB | 1377092 | | 12/1974 |
| GB | 1578930 | | 11/1980 |
| GB | 2094826 | | 9/1982 |
| GB | 2095275 | | 9/1982 |
| GB | 2165856 | | 4/1986 |
| JP | 04238809 | | 3/2006 |
| JP | 04260610 | | 3/2006 |
| RU | 1792953 | A1 | 2/1993 |
| RU | 1821486 | A1 | 6/1993 |
| WO | WO9010695 | | 9/1990 |
| WO | WO9013533 | | 11/1990 |
| WO | WO9101295 | | 2/1991 |
| WO | WO9102792 | | 3/1991 |
| WO | WO9108171 | | 6/1991 |
| WO | WO9116422 | | 10/1991 |
| WO | WO9206984 | | 4/1992 |
| WO | WO9311215 | | 1/1993 |
| WO | WO9316110 | | 8/1993 |
| WO | WO9502675 | | 1/1995 |
| WO | WO9714804 | | 4/1997 |
| WO | WO0050553 | | 8/2000 |
| WO | WO0050556 | | 8/2000 |
| WO | 0102451 | A1 | 12/2001 |
| WO | WO0226927 | | 1/2002 |
| WO | WO0212425 | | 2/2002 |
| WO | WO0212426 | | 2/2002 |

OTHER PUBLICATIONS

M. Brock Neue Entwicklungen auf dem Gebiet der Wäscheweichspüler Tens. Surf. Det. 30, (1993) p. 394.

R. Lagerman et al., Synthesis and Performance of ester Quaternary Biodegradable Softeners, J. Am. Oil. Chem. Soc., 71 (1994) p. 97.

I. Shapiro et al., Environmentally Friendly Ester Quats, Cosm. Toil. 109, (1994) p. 77.

* cited by examiner

BOOSTING CLEANING POWER OF DETERGENTS BY MEANS OF A POLYMER

CROSS-REFERENCE TO RELATED APPLICATIONS

This application is a continuation under 35 U.S.C. §365(c) and 35 U.S.C. § 120 of International Application No. PCT/EP2006/004750, filed May 19, 2996. This application also claims priority under 35 U.S.C. §119 of German Patent Application No. DE 10 2005 026 544.8, filed Jun. 8, 2005. Both the International Application and the German Application are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION (1) Field of the Invention

The present patent application relates to intensifying the cleaning performance of washing agents when washing textiles, by the use of a specific soil-release-enabling polymer.

(2) Description of Related Art, Including Information Disclosed Under 37 C.F.R. §§1.97 and 1.98

Washing agents generally contain, in addition to the ingredients such as surfactants and builder materials that are indispensable for the washing process, further constituents that can be grouped under the heading of "washing adjuvants" and encompass such different groups of active substances as foam regulators, graying inhibitors, bleaching agents, bleach activators, and color transfer inhibitors. Also among such adjuvants are substances that impart soil-repelling properties to the laundry fibers and, if present during the washing operation, support the soil-releasing capability of the other washing-agent constituents. The same also applies analogously to cleaning agents for hard surfaces. Soil-release-enabling substances of this kind are often referred to as "soil release" active substances or, because of their ability to make the treated surface (for example, of the fibers) soil-repellent, as "soil repellents." For example, the soil-release-enabling action of methyl cellulose is known from U.S. Pat. No. 4,136,038. European Patent Application EP 0 213 729 discloses decreased redeposition with the use of washing agents that contain a combination of soap and a nonionic surfactant having alkylhydroxyalkyl cellulose. European Patent Application EP 0 213 730 discloses textile treatment agents that contain cationic surfactants and nonionic cellulose ethers having HLB values from 3.1 to 3.8. U.S. Pat. No. 4,000,093 discloses washing agents that contain 0.1 wt % to 3 wt % alkyl cellulose, hydroxyalkyl cellulose, or alkylhydroxyalkyl cellulose as well as 5 wt % to 50 wt % surfactant, the surfactant component being made up substantially of $C_{10}$ to $C_{13}$ alkyl sulfate and up to 5 wt % $C_{14}$ alkyl sulfate, and less than 5 wt % alkyl sulfate having alkyl radicals of $C_{15}$ and above. U.S. Pat. No. 4,174,305 discloses washing agents that contain 0.1 wt % to 3 wt % alkyl cellulose, hydroxyalkyl cellulose, or alkylhydroxyalkyl cellulose, as well as 5 wt % to 50 wt % surfactant, the surfactant component being made up substantially of $C_{10}$ to $C_{12}$ alkylbenzenesulfonate and comprising less than 5 wt % alkylbenzenesulfonate having alkyl radicals of $C_{13}$ and above. European Patent Application EP 0 634 481 relates to a washing agent that contains alkali percarbonate and one or more nonionic cellulose derivatives. Explicitly disclosed among the latter are only hydroxyethyl cellulose, hydroxypropyl cellulose, and methyl cellulose, and (in the context of the Examples) the methylhydroxyethyl cellulose Tylose® MH50, the hydroxypropylmethyl cellulose Methocel® F4M, and hydroxybutyl cellulose. European Patent EP 0 271 312 (P&G) relates to soil-release-enabling active substances, among them cellulose alkyl ethers and cellulose hydroxyalkyl ethers (with DS of 1.5 to 2.7 and molar weights from 2,000 to 100,000) such as methyl cellulose and ethyl cellulose, which are to be used with peroxygen bleaching agents at a weight ratio (based on the active oxygen content of the bleaching agent) from 10:1 to 1:10. European Patent EP 0 948 591 B1 discloses a washing agent in liquid or granular form that imparts, to fabrics and textiles washed therewith, textile appearance advantages such as decreased pilling and linting, color fading prevention, improved abrasion resistance, and/or enhanced softness, and that contains 1 to 80 wt % surfactant, 1 to 80 wt % organic or inorganic builder, 0.1 to 80 wt % of a hydrophobically modified nonionic cellulose ether having a molar weight from 10,000 to 2,000,000, the modification consisting in the presence of optionally oligomerized (degree of oligomerization up to 20) ethyleneoxy- or 2-propyleneoxy-ether units and of $C_8$ to $C_{24}$ alkyl substituents, and such that the alkyl substituents must be present in quantities from 0.1 to 5 wt % based on the cellulose ether material.

Because of their chemical similarity to polyester fibers, soil-release-enabling active substances that are particularly active for textiles made of said material are copolyesters that contain dicarboxylic acid units, alkylene glycol units, and polyalkylene glycol units. Soil-release-enabling copolyesters of the aforesaid kind, and the use thereof in washing agents, have been known for some time.

German Application DT 16 17 141, for example, describes a washing method using polyethylene terephthalate-polyoxyethlene glycol copolymers. German Application DT 22 00 911 relates to washing agents that contain nonionic surfactant and a mixed polymer of polyoxyethylene glycol and polyethylene terephthalate. German Application DT 22 53 063 recites acid textile finishing agents that contain a copolymer of a dibasic carboxylic acid and an alkylene or cycloalkylene polyglycol as well as, if applicable, an alkylene or cycloalkylene glycol. Polymers of ethylene terephthalate and polyethylene oxide terephthalate in which the polyethylene glycol units have molecular weights from 750 to 5,000 and the molar ratio of ethylene terephthalate to polyethylene oxide terephthalate is 50:50 to 90:10, and the use thereof in washing agents, are described in German Patent DE 28 57 292. Polymers, having a molecular weight of 15,000 to 50,000, of ethylene terephthalate and polyethylene oxide terephthalate, the polyethylene glycol units having molecular weights from 1,000 to 10,000 and the molar ratio of ethylene terephthalate to polyethylene oxide terephthalate being 2:1 to 6:1, can be used according to German Application DE 33 24 258 in washing agents. European Patent EP 066 944 relates to textile treatment agents that contain a copolyester of ethylene glycol, polyethylene glycol, aromatic dicarboxylic acid, and sulfonated aromatic dicarboxylic acid in specific molar ratios. European Patent EP 185 427 discloses polyesters, end-capped with methyl or ethyl groups, having ethylene and/or propylene terephthalate and polyethylene oxide terephthalate units, and washing agents that contain such soil release polymers. European Patent EP 241 984 relates to a polyester that, in addition to oxyethylene groups and terephthalic acid units, also contains substituted ethylene units as well as glycerol units. European Patent EP 241 985 discloses polyesters that, in addition to oxyethylene groups and terephthalic acid units, contain 1,2-propylene, 1,2-butylene, and/or 3-methoxy-1,2-propylene groups as well as glycerol units, and are end-capped with $C_1$ to $C_4$ alkyl groups. European Patent EP 253 567 relates to soil release polymers, having a molar weight from 900 to 9,000, of ethylene terephthalate and polyethylene oxide terephthalate, the polyethylene glycol units having molecular weights from 300 to 3,000 and the molar ratio of ethylene terephthalate to polyethylene oxide terephthalate being 0.6 to 0.95. European Patent Application EP 272 033 discloses polyesters, at least in part end-capped with $C_{1-4}$ alkyl or acyl groups, having polypropylene terephthalate and polyoxyethylene terephthalate units. European Patent EP 274 907 describes sulfoethyl end-capped terephthalate-containing soil release polyesters. In European Patent Application EP 357 280, soil release polyesters having terephthalate, alkylene glycol, and poly-$C_{2-4}$ glycol units are manufactured by sulfonation of unsaturated end groups. German Patent Application DE 26 55 551 describes the reaction of such polyesters with isocyanate-group-containing polymers, and use of the polymerizates thereby manufactured to counteract the redeposition of dirt in the context of washing synthetic fibers. German Patent DE 28 46 984 discloses washing agents that contain as a soil-release-enabling polymer, a reaction product of a polyester with a prepolymer that contains terminal isocyanate groups and is obtained from a diisocyanate and a hydrophilic nonionic macrodiol.

The majority of the polymers known from this extensive existing art have the disadvantage that they possess insufficient or no activity in the context of textiles that are not, or at least not predominantly, made of polyester. Many of today's textiles are, however, made of cotton or cotton-polyester mixed fabrics, so that a need exists for soil-release-enabling polymers that are more effective for greasy stains on such textiles.

It has now been found, surprisingly, that polymerizates obtainable from very specific monomers have a very good soil-release-enabling effect specifically on cotton-containing textiles.

BRIEF SUMMARY OF THE INVENTION

The subject matter of the invention is therefore the use of a polymer, obtainable from the monomers styrene, methacrylic acid, hydroxyethyl methacrylate, and methyl methacrylate, to intensify the cleaning performance of washing agents when washing textiles.

BRIEF DESCRIPTION OF THE SEVERAL VIEWS OF THE DRAWING(S)

Not Applicable

DETAILED DESCRIPTION OF THE INVENTION

It is essential that all four of the monomers recited be contained in the polymer used according to the present invention. Those polymers that are obtainable from the proportions of 1 to 30 mol % styrene, 10 to 40 mol % methyl methacrylate, 20 to 60 mol % methacrylic acid, and 1 to 20 mol % hydroxyethyl methacrylate are preferred. Particularly preferred polymers are block polymers, i.e., those in which one monomer, in particular, styrene, is first polymerized on, and this is then reacted in polymerizing fashion, together or successively, with the remaining monomers containing carboxylic acid groups or carboxylate groups. Polymers that are especially suitable according to the present invention have a molar weight of no more than 10,000 D, in particular, from 3,000 D to 8,000 D. The molecular weight can be determined with the aid of usual chromatographic methods, utilizing known standards.

The use according to the present invention can come about, in the context of a washing process, in such a way that the polymer is added separately to a bath containing washing agent, or the polymer is introduced into the bath as a constituent of the washing agent. A further subject of the invention is therefore a washing agent that contains an above-described polymer. The use according to the present invention in the context of a laundry post-treatment method can correspondingly come about in such a way that the polymer is added separately to the rinsing bath, or it is introduced as a constituent of the laundry post-treatment agent, in particular, a conditioner. In this aspect of the invention the aforesaid washing agent can likewise contain the polymer to be used according to the present invention, but can also be free thereof.

A further subject of the invention is a method for washing textiles, in which method a washing agent and the aforesaid soil-release-enabling polymer are used. This method can be carried out manually or, by preference, with the aid of a usual household washing machine. It is possible in this context to utilize the washing agent and the polymer essential to the invention simultaneously or successively. Simultaneous utilization can be carried out particularly advantageously by using a washing agent that contains the polymer.

Washing agents that contain the polymer to be used according to the present invention can contain all the other usual constituents of such agents that do not interact therewith in undesirable fashion. The soil-release-enabling polymer is, by preference, incorporated into washing agents in quantities from 0.1 wt % to 2 wt %, in particular, 0.4 wt % to 1 wt %.

A further aspect of the invention relates to intensifying the cleaning performance of washing agents when washing textiles that are made of or contain cotton.

Surprisingly, it has been found that the polymer used according to the present invention positively influences the action of certain other washing- and cleaning-agent ingredients, and that conversely, the action of the polymer used according to the present invention is intensified by certain other washing-agent ingredients. These effects occur in particular, with enzymatic active substances, in particular, proteases and lipases; with water-insoluble inorganic builders; with water-soluble inorganic and organic builders, especially based on oxidized carbohydrates; with peroxygen-based bleaching agents, especially with alkali percarbonate; with synthetic anionic surfactants of the sulfate and sulfonate type; and with graying inhibitors, for example, other, in particular, anionic, cellulose ethers such as carboxymethyl cellulose, for which reason the use of at least one of the aforesaid further ingredients together with the polymer to be used according to the present invention is preferred.

In a preferred embodiment, such an agent contains nonionic surfactant, selected from fatty alkyl polyglycosides, fatty alkyl polyalkoxylates, in particular, -ethoxylates and/or -propoxylates, fatty acid polyhydroxyamides, and/or ethoxylation and/or propoxylation products of fatty alkylamines, vicinal diols, fatty acid alkyl esters and/or fatty acid amides, and mixtures thereof, in particular, in a quantity in the range from 2 wt % to 25 wt %.

A further embodiment of such agents encompasses the presence of synthetic anionic surfactant of the sulfate and/or sulfonate type, in particular, fatty alkyl sulfate, fatty alkyl ether sulfate, sulfofatty acid esters, and/or sulfofatty acid di-salts, in particular, in a quantity in the range from 2 wt % to 25 wt %. The anionic surfactant is preferably selected from the alkyl or alkenyl sulfates and/or the alkyl or alkenyl ether sulfates in which the alkyl or alkenyl group possesses 8 to 22, in particular, 12 to 18 carbon atoms.

The suitable nonionic surfactants include the alkoxylates, in particular, the ethoxylates and/or propoxylates, of saturated and/or mono- to polyunsaturated linear or branched-chain alcohols having 10 to 22 carbon atoms, by preference, 12 to 18 carbon atoms. The degree of alkoxylation of the alcohols is as a rule between 1 and 20, by preference between 3 and 10. They can be manufactured, in known fashion, by reacting the corresponding alcohols with the corresponding alkylene oxides. The derivatives of the fatty alcohols are particularly suitable, although their branched-chain isomers, in particular, so-called oxo alcohols, can also be utilized to manufacture usable alkoxylates. The alkoxylates, in particular, the ethoxylates, of primary alcohols having linear, in particular, dodecyl, tetradecyl, hexadecyl, or octadecyl radicals, as well as mixtures thereof, are therefore usable. Corresponding alkoxylation products of alkylamines, vicinal diols, and carboxylic acid amides that correspond, in terms of the alkyl portion, to the aforesaid alcohols can also be used. Also suitable are the ethylene-oxide and/or propylene-oxide insertion products of fatty acid alkyl esters, such as those that can be manufactured according to the method indicated in International Patent Application WO 90/13533, and fatty acid polyhydroxyamides such as those that can be manufactured according to the method of U.S. Pat. Nos. 1,985,424, 2,016,962, and U.S. Pat. No. 2,703,798 and International Patent Application WO 92/06984. So-called alkyl polyglycosides suitable for incorporation into the agents according to the present invention are compounds of the general formula $(G)_n$—$OR^{12}$, in which $R^{12}$ denotes an alkyl or alkenyl radical having 8 to 22 carbon atoms, G a glycose unit, and n a number between 1 and 10. Compounds of this kind, and the manufacture thereof, are described, for example, in European Patent Applications EP 92 355, EP 301 298, EP 357 969, and EP 362 671, or U.S. Pat. No. 3,547,828. The glycoside component $(G)_n$ refers to oligomers or polymers made of naturally occurring aldose or ketose monomers, including, in particular, glucose, mannose, fructose, galactose, talose, gulose, altrose, allose, idose, ribose, arabinose, xylose, and lyxose. The oligomers made up of such glycosidically linked monomers are characterized not only by the nature of the sugars contained in them but also by the quantity thereof (the so-called degree of oligomerization). The degree of oligomerization n, as a variable to be ascertained analytically, generally assumes fractional numerical values; it has values between 1 and 10, and for the glycosides that are used by preference, a value below 1.5, in particular, between 1.2 and 1.4. Because of its good availability, glucose is a preferred monomer module. The alkyl or alkenyl portion $R^{12}$ of the glycosides preferably also derives from easily accessible derivatives of renewable raw materials, in particular, from fatty alcohols, although their branched-chain isomers, in particular, so-called oxo alcohols, can also be used to manufacture usable glycosides. The primary alcohols having linear octyl, decyl, dodecyl, tetradecyl, hexadecyl, or octadecyl radicals, as well as mixtures thereof, are therefore particularly usable. Particularly preferred alkyl glycosides contain a coconut fatty alkyl radical, i.e., mixtures where substantially $R^{12}$=dodecyl and $R^{12}$=tetradecyl.

Nonionic surfactant is contained in agents that contain a polymer used according to the present invention, by preference, in quantities from 1 wt % to 30 wt %, in particular, from 1 wt % to 25 wt %; quantities in the upper portion of this range are more likely to be found in liquid washing agents, and particulate washing agents, by preference, contain rather smaller quantities of up to 5 wt %.

The agents can contain, instead or additionally, further surfactants, by preference synthetic anionic surfactants of the sulfate or sulfonate type, such as, for example, alkylbenzenesulfonates, in quantities by preference not more than 20 wt %, in particular, from 0.1 wt % to 18 wt %, based in each case on the entire agent. The alkyl and/or alkenyl sulfates having 8 to 22 carbon atoms, and which carry an alkali-, ammonium-, or alkyl- or hydroxyalkyl-substituted ammonium ion as a counter-cation, may be mentioned as synthetic anionic surfactants particularly suitable for use in such agents. The derivatives of fatty alcohols having, in particular, 12 to 18 carbon atoms, and their branched-chain analogs (the so-called oxo alcohols), are preferred. The alkyl and alkenyl sulfates can be manufactured in known fashion by reacting the corresponding alcohol component with a usual sulfating reagent, in particular, sulfur trioxide or chlorosulfonic acid, and subsequent neutralization with alkali-, ammonium-, or alkyl- or hydroxyalkyl-substituted ammonium bases. Alkyl and/or alkenyl sulfates of this kind are contained in the agents by preference in quantities from 0.1 wt % to 15 wt %, in particular, from 0.5 wt % to 10 wt %.

The usable surfactants of the sulfate type also include the sulfated alkoxylation products of the aforesaid alcohols (so-called ether sulfates). Ether sulfates of this kind by preference contain 2 to 30, in particular, 4 to 10 ethylene glycol units per molecule. Among the suitable anionic surfactants of the sulfonate type are the □-sulfoesters obtainable by reacting fatty acid esters with sulfur trioxide with subsequent neutralization, in particular, the sulfonation products deriving from fatty acids having 8 to 22 carbon atoms, by preference, 12 to 18 carbon atoms, and linear alcohols having 1 to 6 carbon atoms, by preference, 1 to 4 carbon atoms, as well as the sulfofatty acids proceeding therefrom by formal saponification.

Further appropriate optional surface-active ingredients are soaps, saturated fatty acid soaps such as the salts of lauric acid, myristic acid, palmitic acid, or stearic acid, as well as soaps derived from natural fatty acid mixtures, for example, coconut, palm-kernel, or tallow fatty acids, being suitable. Particularly preferred are those soap mixtures that comprise 50 wt % to 100 wt % saturated $C_{12}$ to $C_{18}$ fatty acid soaps and up to 50 wt % oleic acid soap. Soap is contained by preference in quantities from 0.1 wt % to 5 wt %. Greater quantities of soap, as a rule up to 20 wt %, can, however, also be contained in particular, in liquid agents that contain a polymer used according to the present invention.

In a further embodiment, an agent that contains a polymer to be used according to the present invention contains water-soluble and/or water-insoluble builders, selected in particular, from alkali aluminosilicate, crystalline alkali silicate with a modulus greater than 1, monomeric polycarboxylate, polymeric polycarboxylate, and mixtures thereof, in particular, in quantities in a range from 2.5 wt % to 60 wt %.

An agent that contains a polymer to be used according to the present invention contains by preference 20 wt % to 55 wt % water-soluble and/or water-insoluble, organic and/or inorganic builders. Among the water-soluble organic builder substances are, in particular, those from the class of the polycarboxylic acids, in particular, citric acid and sugar acids, as well as the polymeric (poly)carboxylic acids, in particular, the polycarboxylates of International Patent Application WO 93/16110 accessible by oxidation of polysaccharides; polymeric acrylic acids; methacrylic acids; maleic acids; and mixed polymers thereof, which can also contain small polymerized-in portions of polymerizable substances having no carboxylic acid functionality. The relative molecular weight of the homopolymers of unsaturated carboxylic acids is generally between 5,000 and 200,000, that of the copolymers between 2,000 and 200,000, by preference 50,000 to 120,000, based on free acid. A particularly preferred acrylic acid/maleic acid copolymer has a relative molecular weight from 50,000 to 100,000. Suitable, although less preferred, compounds of this class are copolymers of acrylic acid or methacrylic acid with vinylethers, such as vinylmethylether, vinyl esters, ethylene, propylene, and styrene, in which the acid concentration is at least 50 wt %. Also usable as water-soluble organic builder substances are terpolymers that contain two carboxylic acids and/or salts thereof as monomers, as well as vinyl alcohol and/or a vinyl alcohol derivative or a carbohydrate as a third monomer. The first acid monomer or its salt is derived from a monoethylenically unsaturated $C_3$ to $C_8$ carboxylic acid and by preference from a $C_3$ to $C_4$ monocarboxylic acid, in particular, from (meth)acrylic acid. The second acid monomer or its salt can be a derivative of a $C_4$ to $C_8$ dicarboxylic acid, maleic acid being particularly preferred. The third monomeric unit is constituted in this case by vinyl alcohol and/or, by preference, an esterified vinyl alcohol. Particularly preferred are vinyl alcohol derivatives that represent an ester of short-chain carboxylic acids, for example, $C_1$ to $C_4$ carboxylic acids, with vinyl alcohol. Preferred terpolymers contain 60 wt % to 95 wt %, in particular, 70 wt % to 90 wt %, (meth)acrylic acid or (meth)acrylate, particularly preferably acrylic acid or acrylate, and maleic acid or maleinate, as well as 5 wt % to 40 wt %, by preference 10 wt % to 30 wt %, vinyl alcohol and/or vinyl acetate. Very particularly preferred in this context are terpolymers in which the weight ratio of (meth)acrylic acid or (meth)acrylate to maleic acid or maleate is between 1:1 and 4:1, by preference between 2:1 and 3:1, and in particular, 2:1 and 2.5:1. Both the quantities and the weight ratios are based on the acids. The second acid monomer or its salt can also be a derivative of an allylsulfonic acid that is substituted in the 2-position with an alkyl radical, by preference with a $C_1$ to $C_4$ alkyl radical, or with an aromatic radical that is by preference derived from benzene or benzene derivatives. Preferred terpolymers in this context contain 40 wt % to 80 wt %, in particular, 45 to 55 wt %, (meth)acrylic acid or (meth)acrylate, particularly preferably acrylic acid or acrylate; 10 wt % to 30 wt %, by preference 15 wt % to 25 wt %, methallylsulfonic acid or methallyl sulfonate; and, as a third monomer, 15 wt % to 40 wt %, by preference 20 wt % to 40 wt % of a carbohydrate. This carbohydrate can be, for example, a mono-, di-, oligo-, or polysaccharide, mono-, di-, or oligosaccharides being preferred; sucrose is particularly preferred. The use of the third monomer probably incorporates defined break points into the polymer, which are responsible for the polymer's good biodegradability. These terpolymers can be manufactured, in particular, according to methods that are described in German Patent DE 42 21 381 and German Patent Application DE 43 00 772, and generally have a relative molecular weight between 1,000 and 200,000, by preference, between 200 and 50,000, and in particular, between 3,000 and 10,000. Especially for the manufacture of liquid agents, they can be used in the form of aqueous solutions, by preference in the form of 30-wt % to 50-wt % aqueous solutions. All the aforesaid polycarboxylic acids are used, as a rule, in the form of their water-soluble salts, in particular, their alkali salts.

Organic builder substances of this kind are contained by preference in quantities of up to 40 wt %, in particular, up to 25 wt %, and particularly preferably from 1 wt % to 5 wt %. Quantities close to the aforesaid upper limit are by preference used in pasty or liquid, in particular, aqueous agents.

Crystalline or amorphous alkali aluminosilicates are used, in particular, as water-insoluble, water-dispersible inorganic builder materials, in quantities of up to 50 wt %, by preference no more than 40 wt %, and in liquid agents, in particular, from 1 wt % to 5 wt %. Preferred among these are the crystalline aluminosilicates of washing-agent grade, in particular, zeolite NaA and, if applicable, NaX. Quantities close to the aforesaid upper limit are used by preference in solid, particulate agents. Suitable aluminosilicates comprise, in particular, no particles having a particle size greater than 30 μm, and by preference comprise at least 80 wt % of particles having a size below 10 μm. Their calcium binding ability, which can be determined as indicated by German Patent DE 24 12 837, is in the range from 100 to 200 mg CaO per gram. Suitable substitutes or partial substitutes for the aforesaid aluminosilicate are crystalline alkali silicates, which can be present alone or mixed with amorphous silicates. The alkali silicates usable as detergency builders in the agents preferably have a molar ratio of alkali oxide to $SiO_2$ below 0.95, in particular, from 1:1.1 to 1:12, and can be present in amorphous or crystalline fashion. Preferred alkali silicates are the sodium silicates, in particular, the amorphous sodium silicates, having a molar $Na_2O:SiO_2$ ratio from 1:2 to 1:2.8. Amorphous alkali silicates of this kind are commercially available, for example, under the name Portil®. Those having a molar $Na_2O:SiO_2$ ratio from 1:1.9 to 1:2.8 can be manufactured according to the method of European Patent Application EP 0 425 427. They are added in the context of manufacture preferably as a solid and not in the form of a solution. Crystalline sheet silicates of the general formula $Na_2Si_xO_{2x+1}\cdot yH_2O$, in which x (the so-called modulus) is a number from 1.9 to 4 and y a number from 0 to 20, and preferred values for x are 2, 3, or 4, are used by preference as crystalline silicates, which can be present alone or mixed with amorphous silicates. Crystalline sheet silicates that conform to this general formula are described, for example, in European Patent Application EP 0 164 514. Preferred crystalline sheet silicates are those in which x in the aforesaid general formula assumes the value 2 or 3. Both □- and □-sodium disilicates ($Na_2Si_2O_5\cdot yH_2O$) are preferred; □-sodium disilicates can be obtained, for example, according to the method described in International Patent Application WO 91/08171. □-Sodium silicates having a modulus between 1.9 and 3.2 can be manufactured according to Japanese Patent Applications JP 04/238 809 or JP 04/260 610. Practically anhydrous crystalline alkali silicates manufactured from amorphous alkali silicates and of the aforesaid general formula in which x denotes a number from 1.9 to 2.1, capable of being manufactured as described in European Patent Applications EP 0 548 599, EP 0 502 325, and EP 0 425 428, can also be used in agents that contain a combination used according to the present invention. In a further preferred embodiment of the agents, a crystalline sodium sheet silicate having a modulus from 2 to 3, such as the one that can be manufactured from sand and soda according to the method of European Patent Application EP 0 436 835, is used. Crystalline sodium silicates having a modulus in the range from 1.9 to 3.5, such as those obtainable according to the method of European Patents EP 0 164 552 and/or European Patent Application EP 0 294 753, are used in a further preferred embodiment of washing or cleaning agents that contain a polymer used according to the present invention. Their alkali silicate content is by preference 1 wt % to 50 wt %, and in particular, 5 wt % to 35 wt %, based on anhydrous active substance. If alkali aluminosilicate, in particular, zeolite, is also present as an additional builder substance, the alkali silicate content is by preference 1 wt % to 15 wt % and, in particular, 2 wt % to 8 wt %, based on anhydrous active substance. The weight ratio of aluminosilicate to silicate, based in each case on anhydrous active substances, is then by preference 4:1 to 10:1. In agents that contain both amorphous and crystalline alkali silicates, the weight ratio of amorphous alkali silicate to crystalline alkali silicate is by preference 1:2 to 2:1, and in particular, 1:1 to 2:1.

In addition to the aforesaid inorganic builders, further water-soluble or water-insoluble inorganic substances can be utilized in the agents that contain a polymer to be used according to the present invention. The alkali carbonates, alkali hydrogencarbonates, and alkali sulfates, and mixtures thereof, are suitable in this connection. Additional inorganic material of this kind can be present in quantities of up to 70 wt %.

In addition, the agents can contain further constituents that are usual in washing and cleaning agents. These optional constituents include, in particular, enzymes; enzyme stabilizers; bleaching agents; bleach activators; complexing agents for heavy metals, for example, aminopolycarboxylic acids, aminohydroxypolycarboxylic acids, polyphosphonic acids, and/or aminopolyphosphonic acids; color-fixing active substances; color transfer inhibitors, for example, polyvinylpyrrolidone or polyvinylpyridine-N oxide; foam inhibitors, for example, organopolysiloxanes or paraffins; solvents; and optical brighteners, for example, stilbenedisulfonic acid derivatives. Agents that contain a combination used according to the present invention by preference contain up to 1 wt %, in particular, 0.01 wt % to 0.5 wt %, optical brighteners, in particular, compounds from the class of the substituted 4,4'-bis-(2,4,6-triamino-s-triazinyl)stilbene-2,2'-disulfonic acids; up to 5 wt %, in particular, 0.1 wt % to 2 wt %, complexing agents for heavy metals, in particular, aminoalkylenephosphonic acids and salts thereof; up to 3 wt %, in particular, 0.5 wt % to 2 wt %, graying inhibitors; and up to 2 wt %, in particular, 0.1 wt % to 1 wt %, foam inhibitors, the aforesaid weight proportions referring in each case to the entire agent.

Solvents, which are used in particular, in liquid agents, are (in addition to water) by preference those that are miscible with water. Among these are the lower alcohols, for example, ethanol, propanol, isopropanol, and the isomeric butanols; glycerol; lower glycols, for example, ethylene and propylene glycol; and the ethers derivable from the aforesaid compound classes. The polymer used according to the present invention, or the constituents of the combination used according to the present invention, is/are generally present in such liquid agents in dissolved or suspended form.

Enzymes that are present, if applicable, are by preference selected from the group encompassing protease, amylase, lipase, cellulase, hemicellulase, oxidase, peroxidase, or mixtures thereof. Protease obtained from microorganisms, such as bacteria or fungi, is especially suitable. It can be obtained in known fashion by fermentation processes from suitable microorganisms that are described, for example, in German Applications DE 19 40 488, DE 20 44 161, DE 21 01 803, and DE 21 21 397, U.S. Pat. No. 3,623,957 and U.S. Pat. No. 4,264,738, European Patent Application EP 006 638, and International Patent Application WO 91/02792. Proteases are obtainable commercially, for example, under the names BLAP®, Savinase®, Esperase®, Maxatase®, Optimase®, Alcalase®, Durazym®, or Maxapem®. The usable lipases can be obtained from *Humicola lanuginosa* as described, for example, in European Patent Applications EP 258 068, EP 305 216, and EP 341 947; from *Bacillus* species as described, for example, in International Patent Application WO 91/16422 or European Patent Application EP 384 717; from *Pseudomonas* species as described, for example, in European Patent Applications EP 468 102, EP 385 401, EP 375 102, EP 334 462, EP 331 376, EP 330 641, EP 214 761, EP 218 272, or EP 204 284, or International Patent Application WO 90/10695; from *Fusarium* species as described, for example, in European Patent Application EP 130 064; from *Rhizopus* species as described, for example, in European Patent Application EP 117 553; or from *Aspergillus* species as described, for example, in European Patent Application EP 167 309. Suitable lipases are commercially obtainable, for example, under the names Lipolase®, Lipozym®, Lipomax®. Amano® Lipase, Toyo-Jozo® Lipase, Meito® Lipase, and Diosynth® Lipase. Suitable amylases are commercially available, for example, under the names Maxamyl®, Termamyl®, Duramyl®, and Purafect® OxAm. The usable cellulase can be an enzyme, obtainable from bacteria or fungi, that has a pH optimum by preference in the weakly acid to weakly alkaline range from 6 to 9.5. Cellulases of this kind are known, for example, from German Applications DE 31 17 250, DE 32 07 825, DE 32 07 847, DE 33 22 950, or European Patent Applications EP 265 832, EP 269 977, EP 270 974, EP 273 125, and EP 339 550, and International Patent Applications WO 95/02675 and WO 97/14804, and commercially available under the names Celluzyme®, Carezyme®, and Ecostone®.

Among the usual enzyme stabilizers that are present, if applicable, in liquid agents in particular, are aminoalcohols, for example, mono-, di- triethanolamine and -propanolamine and mixtures thereof; lower carboxylic acids as known, for example, from European Patent Applications EP 376 705 and EP 378 261; boric acid or alkali borates; boric acid/carboxylic acid combinations as known, for example, from European Patent Application EP 451 921; boric acid esters as known, for example, from International Patent Application WO 93/11215 or European Patent Application EP 511 456; boronic acid derivatives as known, for example, from European Patent Application EP 583 536; calcium salts, for example, the calcium-formic acid combination known from European Patent EP 28 865; magnesium salts as known, for example, from European Patent Application EP 378 262; and/or sulfur-containing reducing agents as known, for example, from European Patent Applications EP 080 748 or EP 080 223.

The suitable foam inhibitors include long-chain soaps, in particular, behenic soap, fatty acid amides, paraffins, waxes, microcrystalline waxes, organopolysiloxanes, and mixtures thereof, which can furthermore contain microfine, optionally silanated or otherwise hydrophobized silicic acid. For use in particulate agents, foam inhibitors of this kind are by preference bound to granular, water-soluble carrier substances, as described for example, in German Application DE 34 36 194, European Patent Applications EP 262 588, EP 301 414, EP 309 931, or European Patent EP 150 386.

A further embodiment of an agent of this kind that contains a polymer to be used according to the present invention contains peroxygen-based bleaching agent, in particular, in quantities in the range from 5 wt % to 70 wt %, and, if applicable, bleach activator, in particular, in quantities in the range from 2 wt % to 10 wt %. These appropriate bleaching agents are the per-compounds generally utilized in washing agents, such as hydrogen peroxide, perborate (which can be present as a tetrahydrate or monohydrate), percarbonate, perpyrophosphate, and persilicate, which as a rule are present as alkali salts, in particular, as sodium salts. Bleaching agents of this kind are present in washing agents that contain a polymer used according to the present invention by preference in quantities of up to 25 wt %, in particular, up to 15 wt %, and particularly preferably from 5 wt % to 15 wt %, based in each case on the entire agent; percarbonate, in particular, is used. The optionally present bleach activator component encompasses the usually utilized N- or O-acyl compounds, for example, multiply acylated alkylenediamines, in particular, tetraacetylethylenediamine, acylated glycolurils, in particular, tetraacetylglycoluril, N-acylated hydantoins, hydrazides, triazoles, urazoles, diketopiperazines, sulfurylamides, and cyanurates; also carboxylic acid anhydrides, in particular, phthalic acid anhydride, carboxylic acid esters, in particular, sodium isononanoyl phenolsulfonate, and acylated sugar derivatives, in particular, pentaacetyl glucose, as well as cationic nitrile derivatives such as trimethylammonium acetonitrile salts. In order to prevent interaction with the per-compounds in storage, the bleach activators can be coated or granulated in known fashion with enveloping substances; tetraacetylethylenediamine granulated with the aid of carboxymethyl cellulose and having average particle sizes from 0.01 mm to 0.8, that can be manufactured, e.g., according to the method described in European Patent EP 37 026; granulated 1,5-diacetyl-2,4-dioxohexahydro-1,3,5-triazine that can be manufactured according to the method described in German Patent DD 255 884; and/or trialkylammonium acetonitrile produced in particle form according to the methods described in International Patent Applications WO 00/50553, WO 00/50556, WO 02/12425, WO 02/12426, or WO 02/26927, is particularly preferred. Bleach activators of this kind are contained in washing agents by preference in quantities of up to 8 wt %, in particular, from 2 wt % to 6 wt %, based in each case on the entire agent.

It is also possible to use the aforesaid polymer together with a polyester-active soil-release-enabling polymer of dicarboxylic acid and diol, which can also be a polymeric diol or a mixture of monomeric and polymeric diol, in order to intensify the cleaning performance of washing agents when washing textiles.

Among the known polyester-active soil-release-enabling polymers that can be used in addition to the polymer essential to the invention are copolyesters of dicarboxylic acids, for example, adipic acid, phthalic acid, or terephthalic acid; diols, for example, ethylene glycol or propylene glycol; and polydiols, for example, polyethylene glycol or polypropylene glycol. The soil-release-enabling polymers that are preferably used include those compounds that are accessible formally by esterification of two monomer parts, the first monomer being a dicarboxylic acid HOOC-Ph-COOH and the second monomer a diol HO—$(CHR^{11})_a$OH, which can also be present as a polymeric diol H—(O—$(CHR_{11}$—$)_a)_b$OH. Here Ph denotes an o-, m-, or p-phenyl radical that can carry 1 to 4 substituents selected from alkyl radicals having 1 to 22 carbon atoms, sulfonic acid groups, carboxyl groups, and mixtures thereof; $R^{11}$ denotes hydrogen, an alkyl radical having 1 to 22 carbon atoms, and mixtures thereof; a is a number from 2 to 6, and b a number from 1 to 300. By preference, both monomer diol units —O— $(CHR_{11}$—$)_a$O— and polymer diol units —(O$(CHR^{11}$—$)_a)_b$O— are present in the polyesters obtainable therefrom. The molar ratio of monomer diol units to polymer diol units is by preference 100:1 to 1:100, in particular, 10:1 to 1:10. In the polymer diol units, the degree of polymerization b is by preference in the range from 4 to 200, in particular, from 12 to 140. The molecular weight or average molecular weight, or the maximum of the molecular weight distribution, of preferred soil-release-enabling polyesters is in the range from 250 to 100,000, in particular, from 500 to 50,000. The acid on which the Ph radical is based is selected by preference from terephthalic acid, isophthalic acid, phthalic acid, trimellitic acid, mellitic acid, the isomers of sulfophthalic acid, sulfoisophthalic acid, and sulfoterephthalic acid, and mixtures thereof. If their acid groups are not part of the ester bonds in the polymer, they are by preference present in salt form, in particular, as an alkali or ammonium salt. Among these, the sodium and potassium salts are particularly preferred. If desired, instead of the HOOC-Ph-COOH monomer, small proportions, in particular, no more than 10 mol % based on the proportion of Ph having the meaning indicated above, of other acids that comprise at least two carboxyl groups can be contained in the soil-release-enabling polyester. These include, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. The preferred diols HO-$(CHR^{11}$-$)_a$OH include those in which $R^{11}$ is hydrogen and a is a number from 2 to 6, and those in which a has a value of 2 and $R^{11}$ is selected from hydrogen and the alkyl radicals having 1 to 10, in particular, 1 to 3, carbon atoms. Particularly preferred among the diols just recited are those of the formula HO—$CH_2$—$CHR^{11}$—OH, in which $R^{11}$ has the aforementioned meaning. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Polyethylene glycol having an average molar weight in the range from 1,000 to 6,000 is particularly preferred among the polymeric diols.

If desired, the polyesters having compositions as described above can also be end-capped, alkyl groups having 1 to 22 carbon atoms, and esters of monocarboxylic acids, being appropriate as terminal groups. The terminal groups, bound via ester bonds, can be based on alkyl, alkenyl, and aryl monocarboxylic acids having 5 to 32 carbon atoms, in particular, 5 to 18 carbon atoms. These include valeric acid, hexanoic acid, enanthic acid, octanoic acid, pelargonic acid, decanoic acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, benzoic acid, which can carry 1 to 5 substituents having a total of up to 25 carbon atoms, in particular, 1 to 12 carbon atoms, for example, tert.-butylbenzoic acid. The terminal groups can also be based on hydroxymonocarboxylic acids having 5 to 22 carbon atoms, which include, e.g., hydroxyvaleric acid, hydroxyhexanoic acid, ricinoleic acid, its hydrogenation product hydroxystearic acid, and o-, m-, and p-hydroxybenzoic acid. The hydroxymonocarboxylic acids can in turn be connected to one another via their hydroxyl group and their carboxyl group, and thus be present in multiple fashion in one terminal group. The number of hydroxymonocarboxylic acid units per terminal group, i.e., their degree of oligomerization, is by preference in the range from 1 to 50, in particular, from 1 to 10. In a preferred embodiment of the invention, polymers of ethylene terephthalate and polyethylene oxide terephthalate, in which the polyethylene glycol units have molecular weights from 750 to 5,000 and the molar ratio of ethylene terephthalate to polyethylene oxide terephthalate is 50:50 to 90:10, are used together with the polymer that is essential to the invention.

The soil-release-enabling polymers are by preference water-soluble; the term "water-soluble" is to be understood as a solubility of at least 0.01 g, by preference 0.1 g, of the polymer per liter of water at room temperature and pH 8.

Polymers used in preferred fashion have under these conditions, however, a solubility of at least 1 g per liter, in particular, at least 10 g per liter.

Preferred laundry post-treatment agents that contain a polymer to be used according to the present invention comprise as a laundry-softening active substance a so-called esterquat, i.e., a quaternized ester of carboxylic acid and aminoalcohol. These are known substances that can be obtained according to the relevant methods of preparative organic chemistry. Reference may be made in this context to International Patent Application WO 91/01295, according to which triethanolamine is partially esterified with fatty acids in the presence of hypophosphoric acid, air is fed through, and quaternization is then performed using dimethyl sulfate or ethylene oxide. German Patent DE 43 08 794 furthermore discloses a method for the manufacture of solid esterquats in which the quaternization of triethanolamine esters is carried out in the presence of suitable dispersing agents, by preference fatty alcohols. Reviews of this subject have appeared, for example, in R. Puchta et al., Tens.Surf.Det., 30, 186 (1993), M. Brock, Tens.Surf.Det. 30, 394 (1993), R. Lagerman et al., J.Am.Oil.Chem.Soc. 71, 97 (1994), and I. Shapiro, Cosm. Toil. 109, 77 (1994).

Esterquats that are preferred in the agents are quaternized fatty acid triethanolamine ester salts that conform to formula (I)

(I)

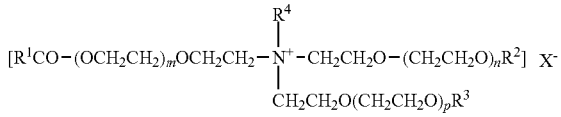

in which $R^1CO$ denotes an acyl radical having 6 to 22 carbon atoms, $R^2$ and $R^3$, mutually independently, denote hydrogen or $R^1CO$, $R^4$ denotes an alkyl radical having 1 to 4 carbon atoms or a $(CH_2CH_2O)_qH$ group, m, n, and p in total equal 0 or numbers from 1 to 12, q denotes numbers from 1 to 12, and X denotes a charge-compensating anion such as a halide, alkyl sulfate, or alkyl phosphate. Typical examples of esterquats that can be utilized for purposes of the invention are products based on hexanoic acid, octanoic acid, decanoic acid, lauric acid, myristic acid, palmitic acid, isostearic acid, stearic acid, oleic acid, elaidic acid, arachidic acid, behenic acid, and erucic acid, as well as technical mixtures thereof such as those that occur, for example, upon high-pressure cleavage of natural fats and oil. Technical $C_{12/18}$ coconut fatty acids, and in particular, partially hardened $C_{16/18}$ tallow or palm fatty acids, as well as elaidic-acid-rich $C_{16/18}$ fatty acid cuts, are used by preference. To manufacture the quaternized esters, the fatty acids and the triethanolamine can, as a rule, be used at a molar ratio from 1.1:1 to 3:1. In terms of the applications-engineering properties of the esterquats, a utilization ratio from 1.2:1 to 2.2:1, by preference 1.5:1 to 1.9:1, has proven particularly advantageous. The esterquats that are preferably used represent technical mixtures of mono-, di-, and triesters having an average degree of esterification from 1.5 to 1.9, and are derived from technical $C_{16/18}$ tallow or palm fatty acid (iodine number 0 to 40). Quaternized fatty acid triethanolamine ester salts of formula (I) in which $R^1CO$ denotes an acyl radical having 16 to 18 carbon atoms, $R^2$ denotes $R^1CO$, $R^3$ hydrogen, and $R^4$ a methyl group, m, n, and p are 0, and X denotes methyl sulfate, have proven particularly advantageous.

In addition to the quaternized carboxylic acid triethanolamine ester salts, suitable esterquats also include quaternized ester salts of carboxylic acids with diethanol alkylamines of formula (II)

(II)

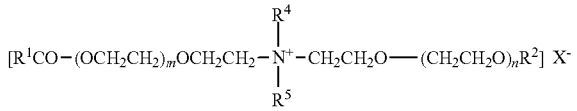

in which $R^1CO$ denotes an acyl radical having 6 to 22 carbon atoms, $R^2$ denotes hydrogen or $R^1CO$, $R^4$ and $R^5$, mutually independently, denote alkyl radicals having 1 to 4 carbon atoms, m and n in total equal 0 or numbers from 1 to 12, and X denotes a charge-compensating anion such as a halide, alkyl sulfate, or alkyl phosphate.

Lastly, a further group of suitable esterquats that may be mentioned is the quaternized ester salts of carboxylic acids with 1,2-dihydroxypropyldialkylamines, of formula (III)

(III)

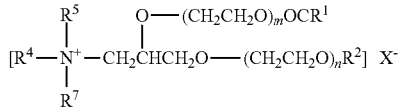

in which $R^1CO$ denotes an acyl radical having 6 to 22 carbon atoms, $R^2$ denotes hydrogen or $R^1CO$, $R^4$, $R^6$, and $R^7$, mutually independently, denote alkyl radicals having 1 to 4 carbon atoms, m and n in total equal 0 or numbers from 1 to 12, and X denotes a charge-compensating anion such as a halide, alkyl sulfate, or alkyl phosphate.

With regard to selection of the preferred fatty acids and the optimum degree of esterification, the exemplifying indications mentioned for (I) also apply analogously to the esterquats of formulas (II) and (III). The esterquats are usually marketed in the form of 50- to 90-weight-percent alcohol solutions, which can also be diluted without difficulty with water; ethanol, propanol, and isopropanol are the usual alcohol solvents.

Esterquats are used by preference in quantities from 5 wt % to 25 wt %, in particular, 8 wt % to 20 wt %, based in each case on the entire laundry post-treatment agent. If desired, the laundry post-treatment agents used according to the present invention can additionally contain washing-agent ingredients presented above, provided they do not interact in unreasonably negative fashion with the esterquat. The agent is preferably a liquid and aqueous one that is easily accessible by mixing the ingredients.

In a preferred embodiment, an agent into which a polymer to be used according to the present invention is incorporated is particulate, and contains up to 25 wt %, in particular, 5 wt % to 20 wt %, bleaching agent, in particular, alkali percarbonate; up to 15 wt %, in particular, 1 wt % to 10 wt %, bleach activator; 20 wt % to 55 wt % inorganic builder; up to 10 wt %, in particular, 2 wt % to 8 wt %, water-soluble organic builder; 10 wt % to 25 wt % synthetic anionic surfactant; 1 wt % to 5 wt % nonionic surfactant; and up to 25 wt %, in particular, 0.1 wt % to 25 wt %, inorganic salts, in particular, alkali carbonate and/or hydrogencarbonate.

In a further preferred embodiment, an agent into which a polymer to be used according to the present invention is incorporated is liquid, and contains 10 wt % to 25 wt %, in particular, 12 wt % to 22.5 wt %, nonionic surfactant; 2 wt % to 10 wt %, in particular, 2.5 wt % to 8 wt %, synthetic anionic surfactant; 3 wt % to 15 wt %, in particular, 4.5 wt % to 12.5 wt %, soap; 0.5 wt % to 5 wt %, in particular, 1 wt % to 4 wt %, organic builder, in particular, a polycarboxylate such as citrate; up to 1.5 wt %, in particular, 0.1 wt % to 1 wt %, complexing agent for heavy metals, such as a phosphonate; and, if applicable, an enzyme, enzyme stabilizer, dye, and/or fragrance, as well as water and/or a water-miscible solvent.

Solid agents are by preference manufactured in such a way that a particle containing the soil-release-enabling polymer is mixed with further washing-agent ingredients present in solid form. A spray-drying step is by preference used to manufacture the particle that contains soil-release-enabling polymer. Alternatively, it is also possible to use a compacting compounding step to manufacture said particle, and optionally also to manufacture the finished agent.

EXAMPLES

Manufacturing a block polymer P1 (molar weight <10,000). Styrene, methacrylic acid, hydroxyethyl methacrylate, and methyl methacrylate were radically polymerized.

Washing Conditions.

| | |
|---|---|
| Washing Machine: | Miele W 918 Novotronic |
| Primary Washing Cycle: | Single-bath method, normal cycle |
| Washing Temperature: | 40° C. |
| Determination | 3X |
| Bath Volume: | 18 l |
| Water Hardness: | 1 6° dH |
| Laundry Load: | 3.5 kg clean laundry |
| Fabric: Cotton | (1.1.10) |

Procedure.

The unstained fabric was washed three times with the washing agent (see below for composition), with and without the addition of polymer P1, under the conditions indicated above, and dried after each wash. After prewashing three times, the fabrics were stained by hand with the following stains:

0.10 g lipstick 0.10 g black shoe polish 0.10 g dust/skin grease

The stained fabrics were measured with a Minolta CR 200 and then aged for seven days at room temperature. The stained fabrics were then attached to hand towels and washed under the conditions indicated above.

The fabrics were dried and then measured again with a Minolta CR 200.

Washing agent composition (wt %)

| | |
|---|---|
| FAEOS | 5% |
| C12/14 7 EO | 12% |
| APG | 2% |
| C12-18 fatty acid | 5% |
| Glycerol | 5% |
| Tinopal ® CBS-X | 0.1% |
| Citrate | 1% |
| Polyacrylate | 2% |
| Protease | + |
| Amylase | + |
| Water to make | 100% |

Washing Results (ddE values).

| | Lipstick | Black Shoe Polish | Dust/Skin Grease |
|---|---|---|---|
| Washing agent without polymer | 26.6 | 47.2 | 53.2 |
| Washing agent + 2% P1 | 34.3 | 55.8 | 57.5 |

The invention claimed is:

1. A method of washing a textile comprising:

adding a copolymer consisting of 1 to 30 mol % styrene, 20 to 60 mol % methacrylic acid, 1 to 20 mol % hydroxyethyl methacrylate, and 10 to 40 mol % methyl methacrylate to a wash bath, and contacting the textile with the copolymer.

2. The method of claim 1 wherein the textile is a cotton textile.

3. The method of claim 1 wherein the polymer is a block copolymer.

4. The method of claim 1 wherein the polymer is added to a cleaning composition comprising a soil-release-enabling polyester of a dicarboxylic acid and diol, a polymeric diol or a mixture thereof prior to adding the polymer to the washing bath.

5. The method of claim 1 wherein the average molar weight of the polymer is less than 10,000 Dalton.

6. The method of claim 5 wherein the average molar weight of the polymer is from 3,000 Dalton to 8,000 Dalton.

7. A washing agent containing a soil-release-enabling copolymer consisting of 1 to 30 mol % styrene, 20 to 60 mol % methacrylic acid, 1 to 20 mol % hydroxyethyl methacrylate, and 10 to 40 mol % methyl methacrylate and having a molar weight of from 3,000 D to 8,000 D.

8. The washing agent of claim 7 wherein the amount of the soil-release-enabling polymer is from 0.1 wt % to 2 wt %, based on total weight of the cleaning composition.

9. The washing agent of claim 8 wherein the amount of the soil-release-enabling polymer is from 0.4 wt % to 1 wt %, based on total weight of the cleaning composition.

10. The method of claim 1 wherein the polymer is added to a washing agent prior to adding the polymer to the wash bath.

11. The method of claim 1 further comprising adding a washing agent to the wash bath.

* * * * *